US005238645A

United States Patent [19]

Sikka et al.

[11] Patent Number: 5,238,645

[45] Date of Patent: Aug. 24, 1993

[54] IRON-ALUMINUM ALLOYS HAVING HIGH ROOM-TEMPERATURE AND METHOD FOR MAKING SAME

[75] Inventors: Vinod K. Sikka, Oak Ridge; Claudette G. McKamey, Knoxville, both of Tenn.

[73] Assignee: Martin Marietta Energy Systems, Inc., Oak Ridge, Tenn.

[21] Appl. No.: 904,802

[22] Filed: Jun. 26, 1992

[51] Int. Cl.[5] ..... C21D 8/00; C22C 38/06

[52] U.S. Cl. ..... 420/79; 420/80; 148/331; 148/334; 148/654

[58] Field of Search ..... 420/77, 79, 81; 148/547, 331, 334, 538, 654

[56] References Cited

U.S. PATENT DOCUMENTS

| | | | |
|---|---|---|---|
| 1,550,508 | 8/1925 | Cooper | 420/79 |
| 1,990,650 | 2/1935 | Jaeger | 420/79 |
| 3,026,197 | 3/1962 | Schramm | 420/79 |
| 3,676,109 | 7/1972 | Cooper | 420/79 |
| 4,961,903 | 10/1990 | McKamey et al. | 420/79 |
| 5,084,109 | 1/1992 | Sikka | 148/12 R |

FOREIGN PATENT DOCUMENTS

| | | | |
|---|---|---|---|
| 2829373 | 1/1979 | Fed. Rep. of Germany | 420/79 |
| 53-119721 | 3/1962 | Japan . | |
| 907731 | 10/1962 | United Kingdom | 420/79 |

OTHER PUBLICATIONS

"Iron-Aluminum Alloy Systems", F. X. Kayser, WADC Technical Report 57-298, Part 1, Wright Air Development Center, Wright-Patterson AFB, Ohio, 1957.

"The Mechanical Properties of Iron-Aluminum Alloys", W. Justusson et al., Transactions of the ASM, vol. 49 (1957) pp. 905-923.

"An Iron-Aluminum-Molybdenum Alloy", J. Dunning, U.S. Department of Interior Report of Investigations No. 8654, U.S. Government Printing Office 1982-505-002/31.

"Relationship Between Atomic Ordering and Fracture in Fe-Al Alloys", M. Marcinkowski et al., Journal of Materials Science, vol. 10 (1975), pp. 406-414.

*Primary Examiner*—Deborah Yee

*Attorney, Agent, or Firm*—Earl L. Larcher; Joseph A. Marasco; Harold W. Adams

[57] ABSTRACT

Iron-aluminum alloys having selectable room-temperature ductilities of greater than 20%, high resistance to oxidation and sulfidation, resistant pitting and corrosion in aqueous solutions, and possessing relatively high yield and ultimate tensile strengths are described. These alloys comprise 8 to 9.5% aluminum, up to 7% chromium, up to 4% molybdenum, up to 0.05% carbon, up to 0.5% of a carbide former such as zirconium, up to 0.1 yttrium, and the balance iron. These alloys in wrought form are annealed at a selected temperature in the range of 700° C. to about 1100° C. for providing the alloys with selected room-temperature ductilities in the range of 20 to about 29%.

24 Claims, 8 Drawing Sheets

IRON-ALUMINUM ALLOYS HAVING HIGH ROOM-TEMPERATURE AND METHOD FOR MAKING SAME

This invention was made with the support of the United States Government under contract No. DE-AC05-84OR21400 awarded by the U.S. Department of Energy. The United States Government has certain rights in this invention.

BACKGROUND OF THE INVENTION

The present invention relates generally to iron-aluminum alloys which possess high room-temperature ductility and high resistance to oxidation, aqueous corrosion, and sulfidation. More particularly, the present invention is directed to such Fe-Al alloys which, when wrought and annealed, have ductilities at room temperature of greater than 20%, which are virtually resistant to hydrogen embrittlement, and which possess tensile properties useful in many applications where Fe-Al alloys can be beneficially employed.

Iron-aluminide alloys are of considerable interest for use as a structural material in place of heavier and more expensive stainless steels since Fe-Al alloys possess levels of resistance to oxidation and sulfidation comparable with and often better than many stainless steels. Of the Fe-Al alloys presently known, the Fe-Al alloys with iron and aluminum concentrations in or near $Fe_3Al$ compositions that have an ordered phase and a lattice structure known as $DO_3$ at temperatures below about 550° C. have been found to be particularly suitable for use as a structural material in applications requiring relatively high ultimate tensile and yield strength. However, it has been found that presently available iron-aluminide alloys suffer some shortcomings which considerably detract from the use of these alloys as structural materials in many applications. For example, presently available Fe-Al alloys lack sufficient room-temperature ductility to permit the formation of the alloys into desired product configurations at relatively low temperatures. These presently available Fe-Al alloys also suffer a significant loss of strength at temperatures above about 600° C., have relatively low resistance to aqueous corrosion and insufficient resistance to environmental embrittlement, as apparently caused by the dissociation of water molecules in the presence of aluminum atoms on the surface of the alloy for forming alloy-embrittling atomic hydrogen.

Efforts to overcome the aforementioned and other shortcomings of Fe-Al alloys as well as to improve the already present desirable characteristics of the Fe-Al alloys including such alloys in or near the $Fe_3Al$ compositions have met with varying degrees of success. Many of these efforts have been directed towards the addition of various alloying elements to the binary iron-aluminum alloys for the purpose of improving the ductility and tensile properties of the alloy. For example, as described in U.S. Pat. No. 1,550,508, issued Aug. 18, 1925, the addition of 5 to 10% chromium to a iron-aluminum alloy containing 12 to 16% aluminum was used to enhance the high temperature workability of the alloy. In another example, U.S. Pat. No. 3,026,197, issued Mar. 20, 1962, describes modifying an iron-aluminum alloy containing between 3 and 18% aluminum by adding zirconium and boron to the alloy for the purpose of controlling grain size in the alloy. Also, as described in commonly assigned U.S. Pat. No. 4,961,903, issued Oct. 9, 1990, iron-aluminum alloys with iron and aluminum concentrations based on the $Fe_3Al$ composition were provided with additions of chromium, molybdenum, niobium, zirconium, vanadium, boron, carbon, and yttrium for increasing the high temperature strength of the alloys and increasing the room-temperature ductility of the alloys from about 2% to 10%. This commonly assigned patent also refers to other prior efforts utilized for the purpose of improving the ductility and tensile properties of iron-aluminum alloys and is incorporated herein by reference.

Other investigations into the Fe-Al alloy system includes a technical article entitled, "An Iron-Aluminum-Molybdenum Alloy as a Chromium-Free Stainless Steel Substitute", by J. S. Dunning, U.S. Department of Interior Report of Investigations No. 8654, (1982) available from the U.S. Government Printing Office (1982-505-002/31). This article describes that ternary iron-aluminum-molybdenum alloys containing 8 nominal weight percent (up to 7.62 actual weight percent) aluminum and 6 weight percent molybdenum can be provided with additions of zirconium and carbon for providing a dispersed phase of zirconium carbide to strengthen the solid solution matrix. The molybdenum was used in the alloy for solid solution strengthening purposes. These alloys were reported as having a room-temperature elongation of up to 18%, ultimate tensile strengths up to about 99 ksi, and yield strengths up to about 78 ksi after heat treating the alloy at 870° C. for one hour. Also, additions of columbium and cerium were made to these alloys and were reported to provide an increase in tensile strengths but yielded room-temperature ductilities of only up to 14%. In another technical article entitled "The Mechanical Properties of Iron-Aluminum Alloys" by W. Justusson et al, Transactions of the ASM, Vol. 49, pp 905–923, 1957, several variables affecting the ductility of iron-aluminum alloys were examined. This article reported on room temperature mechanical properties of Fe-Al alloys containing up to 16% aluminum and such alloys containing carbon and carbon plus titanium. The alloys were hot worked, annealed at 1400° F. for one hour and furnace cooled or water quenched. This investigation revealed that the ductility decreased while the tensile strength and the yield strength of the furnace cooled alloys increased in alloys with increasing aluminum content and that a sharp decrease in ductility occurs in alloys with an aluminum content between 8 and 10%. A comparison in this article of the differences in the elongation of water quenched and oil quenched alloys containing 14% aluminum showed that the oil quenched alloys had higher ductility over a range of quenching temperatures. The yield strength and elongation of an alloy containing 11% aluminum were also determined over a range of quenching temperatures which illustrated that the elongation of the alloy rapidly increased while the yield strength of the alloy rapidly decreased with quenching temperatures between about 482° to 649° C. The authors in this article also reported that in alloys with less than 10% weight percent aluminum and carbon up to several weight percent the ductility of the alloys was retained at 10 to 15% regardless of heat treatment but that the oxidation resistance was seriously affected.

A more recent effort to increase room-temperature ductility and reduce hydrogen embrittlement of iron-aluminum alloys in or near the $Fe_3Al$ compositions is described in commonly assigned U.S. Pat. No. 5,084,019, issued Jan. 12, 1992 and incorporated herein by reference. This patent is directed to thermomechanically working the alloys to produce an elongated grain structure in the alloys and quenching the alloys at a temperature greater than about 650° C. for providing the worked alloys with a B2-type ordered structure. These alloys, when heat-treated at 700° C. followed by an oil quench, provided room-temperature ductility approaching 20% with both yield strength and ultimate tensile strength increasing with increasing ductility. Also, because of elongated grain structure, a reduced number of grain boundaries were present in the direction transverse to the working direction so as to significantly reduce diffusion paths for the hydrogen into the alloy for reducing hydrogen embrittlement.

The aforementioned and other efforts previously employed for improving properties of Fe-Al alloys of various aluminum concentrations including alloys incorporating selected alloy elements, provided marked improvements in properties of the Fe-Al alloys including improvements in room-temperature ductility, ultimate tensile strength, yield strength, and tensile elongation and a reduction in hydrogen embrittlement. However, even with these improvements there was still a need for providing even greater improvements in the properties of Fe-Al alloys, particularly in the areas of greater room-temperature ductility, greater tensile strength and yield strength at temperatures greater than about 600° C., increased resistance to oxidation, aqueous corrosion pitting and sulfidation, and the minimization of environmental embrittlement so as to provide Fe-Al alloys with properties which will permit their use in an enhanced range of structural applications, many of which now require the use of relatively expensive and heavier stainless steels.

SUMMARY OF THE INVENTION

Accordingly, it is the principal objective or aim of the present invention to provide Fe-Al alloys ranging from binary alloys to, preferably, alloys containing several alloy elements with improved properties including room temperature ductilities greater than 20%, improved tensile properties at elevated temperatures, improved resistance to oxidation, pitting, aqueous corrosion, and sulfidation, and negligible or no hydrogen embrittlement. These alloys provide ultimate tensile and yield strengths exhibiting improvements at high temperatures over the ultimate tensile and yield strengths provided by previously known Fe-Al alloy systems especially those in or near $Fe_3Al$ compositions which, while having slightly greater tensile and yield strengths at temperatures less than about 600° C., possess considerably less room-temperature ductility and resistance to hydrogen embrittlement.

Another object of the present invention is to provide for selectively tailoring the room-temperature ductility of wrought Fe-Al alloys in a range of between 20 to about 29% by employing preselected annealing temperatures greater than about 700° C. followed by air cooling or oil quenching.

A further object of the present invention is to provide such Fe-Al alloys with room-temperature ductility in as cast form by heat treating the as cast structures of the alloy at temperatures of about 800° C. for 1 hour and air cooling or oil quenching the alloys.

It is a still further object of the present invention to provide an Fe-Al alloy having a preferred composition of 8 to 9 wt. % aluminum, about 4.5 to 5.5 wt. % chromium, about 1.8 to 2.2 wt. % molybdenum, about 0.02 to 0.032 wt. % carbon, about 0.15 to 0.25 wt. % of a carbide former, preferably zirconium, and the balance of iron.

In accordance with this invention, it was discovered that by fabricating the alloys with an aluminum concentration in a narrow range of 8.0 to 9.5% by weight and then working the alloys followed by heat treating the resulting wrought alloys to a selected temperature in a narrow temperature range between about 700° C. and about 1100° C. (about 900° C. for alloys of the preferred alloy composition) that the iron aluminum alloys can exhibit selected room temperature ductilities greater than 20% and upwards to about 29%. This control over room-temperature ductility in Fe-Al alloys, especially those containing substantial concentrations of one or more alloying elements used for grain size control, precipitation strengthening, and increasing the resistance of the alloys to oxidation, aqueous corrosion, and pitting in chloride solutions, represents a considerable improvement over previously available Fe-Al alloys. Also, with the relatively low aluminum concentration, the Fe-Al alloys of the present invention are essentially fully resistant to hydrogen embrittlement. This lack of hydrogen embrittlement is believed to be due to the presence of relatively fewer aluminum atoms at the surface of the Fe-Al alloys so as to significantly reduce the production of atomic hydrogen at the alloy surface as compared to Fe-Al alloys containing greater concentrations of aluminum. It is also expected that the disordered crystal system present in the alloys of the present invention is less susceptible to hydrogen embrittlement than the more ordered B2 and $DO_3$ crystal structures found in Fe-Al alloys containing higher concentrations of aluminum.

Generally, the Fe-Al alloys of the present invention comprise 8 to 9.5% aluminum, up to about 7% of one or more alloying constituents selected from the group of elements consisting of chromium, molybdenum, carbon, a carbide former which combines with the carbon to form carbides for controlling grain growth at elevated temperatures, and the balance iron. The alloys are characterized by a single disordered $\alpha$ phase crystal structure, by being substantially non-susceptible to hydrogen embrittlement, and by having room-temperature ductilities of greater than 20% when wrought and annealed at a selected temperature greater than about 700° C. and air cooled or oil quenched. The alloys also have an "as cast" room-temperature yield strength of greater than about 70 ksi. The carbide former is selected from zirconium, niobium, and hafnium. The element zirconium is the preferred carbide former since it also provides resistance to oxide spallation under cyclic conditions.

The concentrations of the alloying constituents in the alloys of the present invention are in the range of about 2 to 7% chromium, about 1 to 4% molybdenum, about 0.02 to 0.05% carbon, and about 0.2 to 0.5% of the carbide former. About 0.1% yttrium can be added to the alloy composition for increasing the oxidation resistance of the alloys.

The alloys are characterized by a room temperature yield strength at 0.2% yield of at least about 70 ksi in both longitudinal and transverse directions and a room temperature ultimate tensile strength of at least about 90 ksi in both longitudinal and transverse directions. Also, the yield strength and the ultimate tensile strength of the alloys of the present invention are considerably greater at temperatures greater than about 600° than alloys in or near the $Fe_3Al$ and the Fe-Al compositions.

The Fe-Al alloys of the present invention are prepared by employing the steps comprising: (a) forming a blend of alloy constituents comprising 8 to 9.5% aluminum, one or more alloying elements selected from chromium in a concentration up to about 7%, molybdenum in a concentration up to about 4%, carbon in a concentration up to about 0.05%, a carbide former in a concentration up to about 0.5% and adequate to combine with the carbon for forming grain-growth inhibiting carbides in the alloy, and the balance iron; (b) forming a melt of the alloy constituents; (c) working the resulting alloy; and (d) annealing the resulting wrought alloy at a selected temperature greater than about 700° C. followed by air cooling or oil quenching. Instead of steps b–d, the alloy blend or the melt of step c may be melted and cast into an article of a desired configuration. Additional fracture strength is provided to the as cast article by annealing it as in step d.

The step of working the alloy is provided by thermomechanically working the alloy through a series of thickness reductions at decreasing temperatures. Also, the step of working the alloy may further include working the alloy at room temperature through a series of thickness reductions with heat treating of the alloy at a temperature of about 800° C. after each of the series of thickness reductions.

Other and further objects of the present invention will become obvious upon an understanding of the illustrative embodiments about to be described or will be indicated in the appended claims, and various advantages not referred to herein will occur to one skilled in the art upon employment of the invention in practice.

Figure 1:
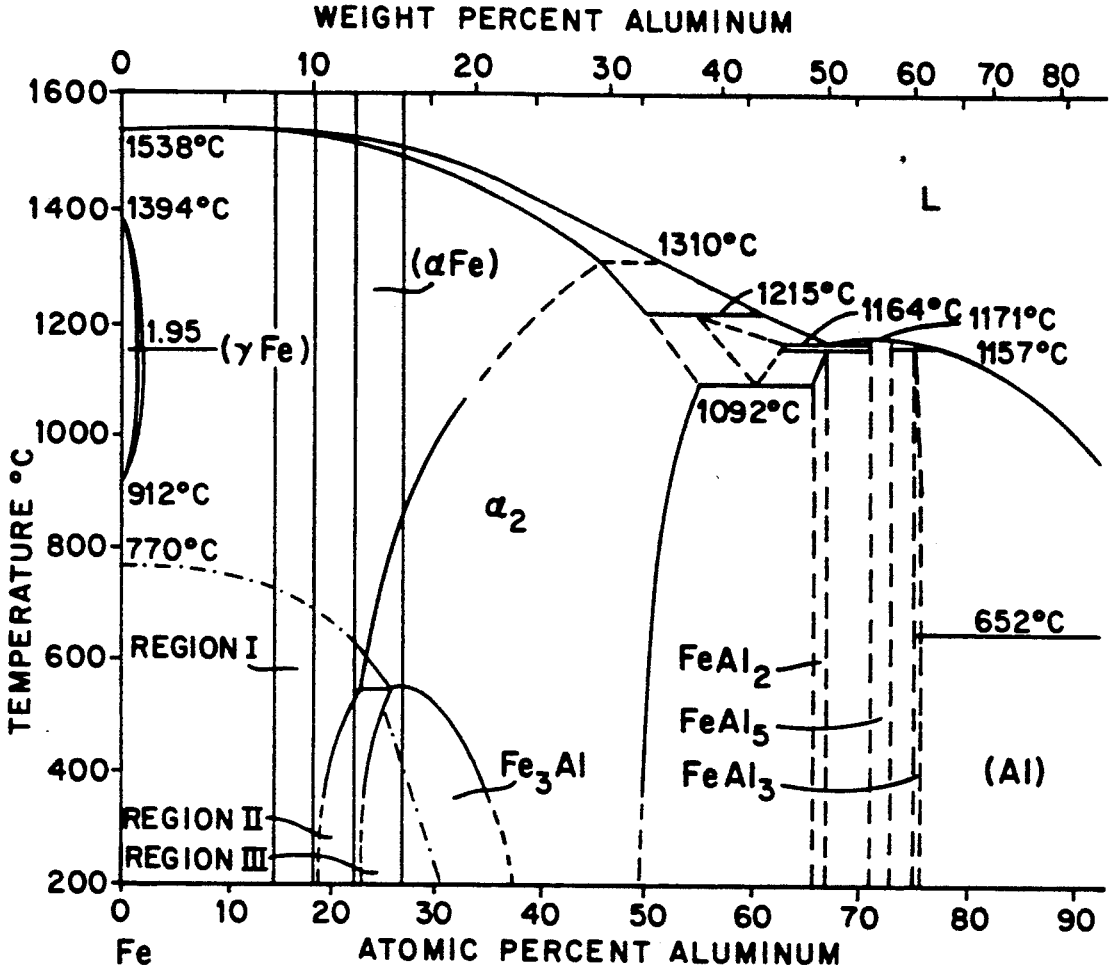
FIG. 1 is a binary phase diagram for Fe-Al alloys and illustrates the region of the aluminum concentration for the alloys of the present invention as well as regions of aluminum concentrations in Fe-Al alloys used herein for the comparison of the tensile properties thereof with the alloys of the present invention.

Graphs representative of the preferred embodiments of the invention have been chosen for the purpose of illustration and description. The graphs illustrated are not intended to be exhaustive nor to limit the invention to the precise properties shown. The graphs are chosen and described in order to best explain the principles of the invention and their application and practical use to thereby enable others skilled in the art to best utilize the invention in various embodiments and modifications as are best adapted to the particular use contemplated.

DETAILED DESCRIPTION

As generally described above, the present invention is directed to improved iron-aluminide alloys which contain 8 to 9.5% by weight of aluminum and are defined by solid solutions of aluminum in $\alpha$ phase iron as a disordered phase with a body-center crystal lattice structure. The composition of these alloys of the present invention range from a binary Fe-Al alloy to Fe-Al alloys preferably containing one or more alloy elements selected from chromium, molybdenum, carbon, and a carbide former such as zirconium which is useable in conjunction with the carbon for forming carbide phases within the solid solution matrix for the purpose of controlling grain size and precipitation strengthening.

In accordance with the present invention it was found that by maintaining the aluminum concentration in the Fe-Al alloys in the narrow range of 8 to 9.5% by weight (nominal) the Fe-Al alloys, with or without the addition of alloying elements, when wrought could be tailored to provide selected room temperature ductilities between 20 and about 29% by annealing the alloys at a selected temperature greater than about 700° C. (700°–1100° C.) and then air cooling or oil quenching the alloys while retaining yield and ultimate tensile strengths, resistance to oxidation, aqueous corrosion and sulfidation favorably comparable to the Fe-Al alloys containing greater than 9.5% by weight aluminum. Also, these alloys of the present invention provide a level of resistance to hydrogen embrittlement significantly greater than that previously found in Fe-Al alloys containing higher concentrations of aluminum except for possibly the alloys described in the aforementioned commonly assigned U.S. Pat. No. 5,084,109.

With aluminum concentrations lower than about 8 wt. % the resulting Fe-Al alloys possess good room-temperature ductility but contain insufficient aluminum for providing acceptable resistance to oxidation and sulfidation. Also, since more iron is present in alloys with less than 8 wt. % aluminum, the tensile strength of the alloys drop dramatically due to the presence of additional iron so as to render the alloy unsuitable for many applications desired for the Fe-Al alloys. On the other hand, with aluminum concentrations greater than 9.5 wt. % ordering of the crystal phases occurs within the Fe-Al alloy so as to induce embrittlement therein which reduces the room-temperature ductility and reduce the high temperature strength of the alloys.

The concentration of the alloying constituents used in forming the Fe-Al alloys of the present invention is expressed herein in nominal weight percent. However, the nominal weight of the aluminum in these alloys essentially corresponds to at least about 97% of the actual weight of the aluminum in the alloys. For example, in the Fe-Al alloy of the preferred composition, as will be described below, a nominal 8.46 wt. % provides an actual 8.40 wt. % of aluminum, which is about 99% of the nominal concentration.

The Fe-Al alloys of the present invention preferably contain one or more selected alloying elements for improving the strength, room-temperature ductility, oxidation resistance, aqueous corrosion resistance, and pitting of the alloys. When chromium is used as an alloying constituent, it is present in an effective amount ranging from more than incidental impurities up to about 7.0% with said effective amount being sufficient to promote resistance to aqueous corrosion of the alloy. A satisfactory concentration of chromium for this purpose is in a range of about 2% to about 7%. When molybdenum is used as one of the alloying constituents it is in an effective ranging from more than incidental impurities up to about 4.0% with said effective amount being sufficient to promote solid solution hardening of the alloy and resistance to pitting of the alloy when exposed to solutions containing chloride. The concentration of the molybdenum is in the range of about 1 to 4%. Molybdenum additions greater than about 4% will not increase resistance to pitting and, in fact, are expected to detract from the room-temperature ductility due to the relatively large extent of solid solution hardening caused by the presence of molybdenum in concentrations greater than about 4%. When carbon and the carbide former are used in the alloy, the carbon is present in an effective amount ranging from more than incidental impurities up to about 0.05% and the carbide former is present in an effective amount ranging from more than incidental impurities up to about 0.5%. The effective amount of the carbon and the carbide former are each sufficient to together provide for the formation of sufficient carbides to control grain growth in the alloy during exposure thereof to increasing temperatures. The carbides also provide some precipitation strengthening in the alloys. The concentration of the carbon and the carbide former in the alloy is such that a stoichiometric or near stoichiometric ratio of carbon to the carbide former is present so that essentially no excess carbon will remain in the finished alloy. A small excess of the carbide former such as zirconium in the alloy is beneficial in as much as it will help form a spallation-resistant oxide during high temperature thermal cycling in air. The carbon concentration is in the range of about 0.02% to about 0.05%. The carbide formers include such carbide-forming elements as zirconium, niobium, and hafnium. The carbide former is preferably zirconium in a concentration sufficient for forming carbides with the carbon present within the alloy with this amount being in the range of about 0.2% to 0.5%. The concentrations for niobium and hafnium when used as carbide formers essentially correspond to those of the zirconium.

In addition to the aforementioned alloy elements the use of about 0.1% yttrium in the alloy composition is beneficial since it has been found that yttrium improves oxidation resistance of alloy to a level greater than that achievable in previously known iron aluminum alloy systems.

The Fe-Al alloys of the present invention are preferably formed by the arc melting, air induction melting, or vacuum induction melting of powdered and/or solid pieces of the selected alloy constituents at a temperature of about 1600° C. in a suitable crucible formed of $ZrO_2$ or the like. The molten alloy is then preferably cast into a mold of graphite or the like in the configuration of a desired product or for forming a heat of the alloy used for the formation of an alloy article by working the alloy.

The "as cast" article possesses room-temperature ductility and fracture strength considerably greater than Fe-Al alloys of greater aluminum content. For example, a casting of an alloy of the preferred composition exhibited a ductile fracture under a load of 5000 lbs while a similarly sized casting of the Fe-12% Al alloy containing the same alloying elements fractured under a load of 500 lbs.

The melt of the alloy to be worked is cut, if needed, into an appropriate size and then reduced in thickness by forging at a temperature in the range of about 900° to 1100° C., hot rolling at a temperature in the range of about 750° to 850° C., warm rolling at a temperature in the range of about 600° to 700° C., and/or cold rolling at room temperature. Each pass through the cold rolls can provide a 20 to 30% reduction in thickness and is followed by heat treating the alloy at a temperature in the range of about 700° to 1,000° C., preferably about 800° C. for one hour. The working of the alloy produces a grain structure which resists hydrogen embrittlement.

For the purposes of this description the wrought alloy specimens set forth in the following tables and in the drawings were prepared by arc melting the alloy constituents to form heats of the various alloys. These heats were cut into 0.5 inch thick pieces which were forged at 1000° C. to reduce the thickness of the alloy specimens to 0.25 inch (50% reduction), then hot rolled at 800° C. to further reduce the thickness of the alloy specimens to 0.1 inch (60% reduction), and then warm rolled at 650° C. to provide a final thickness of 0.030 inch (70% reduction) for the alloy specimens described and tested herein.

In order to compare compositions of alloys formed in accordance with the present invention with one another and with Fe-Al alloys of higher aluminum concentrations, thirteen alloys were prepared with various compositions as shown in Table 1 and contain aluminum concentrations as shown in Regions I, II, and III of FIG. 1.

TABLE 1

| | Weight Percent | | | | | |
|---|---|---|---|---|---|---|
| Alloy | Iron | Aluminum | Chromium | Carbon | Zirconium | Molybdenum |
| FAL-B8 | 91.54 | 8.46 | | | | |
| FAL-B12 | 87.96 | 12.04 | | | | |
| BAL-B16 | 84.10 | 15.90 | | | | |
| FAL-T8 | 86.45 | 8.46 | 5.09 | | | |
| FAL-T12 | 82.69 | 12.04 | 5.27 | | | |
| FAL-T16 | 78.60 | 15.90 | 5.50 | | | |
| FAL-TC8 | 86.40 | 8.46 | 5.09 | 0.05 | | |
| FAL-TC12 | 82.64 | 12.04 | 5.27 | 0.05 | | |
| FAL-TC16 | 78.55 | 15.90 | 5.50 | 0.05 | | |
| FAL-TCZ8 | 86.22 | 8.46 | 5.09 | 0.026 | 0.2 | |
| FAL-TCZ12 | 82.46 | 12.04 | 5.27 | 0.026 | 0.2 | |
| FAL-TCZ16 | 78.37 | 15.90 | 5.50 | 0.026 | 0.2 | |
| FAP | 83.82 | 8.46 | 5.50 | 0.026 | 0.2 | 2.0 |

The alloys in Table 1 are provided with letter and numeral designations relating to the alloy composition and the aluminum concentrations therein. For example, the alloys in Table 1 with the partial designations B8, T8, TC8, TCZ8, and the alloy FAP were formed with 8.46% aluminum and fall within Region I of the phase diagram of FIG. 1. The alloys in Region I are single $\alpha$ phase with a disordered, body centered crystal structure. The alloys in Table 1 with the partial designations B12, T12, TC12, and TCZ12 were formed with 12.04 aluminum and fall within the Region II of the phase diagram of FIG. 1. These alloys in Region II are a mixture of disordered $\alpha$ phase and an ordered phase with a $DO_3$ lattice structure which is present in the alloy at temperatures above about 550° C. The alloys in Table 1 with the partial designations B16, T16, TC16, and TZ16 incorporate 15.90% aluminum and fall within Region III of the phase diagram of FIG. 1 where the alloys possess a single, fully ordered crystal phase with a $DO_3$ lattice structure. The alloy with the designation FAP in Table 1 is the preferred alloy composition of the present invention and is formed of 8–9% aluminum, 4.5 to 5.5% chromium, 1.8–2.2% molybdenum, 0.15–0.25% zirconium, 0.018–0.032% carbon, and the balance iron.

The room temperature tensile properties of alloys having compositions as in Table 1 except for the FAP alloy and after annealing at 700° C. for one hour followed by quenching in mineral oil or air cooling are illustrated in Table 2.

TABLE 2

| Alloy | Cooling Medium | Strength (MPa) 0.2% Yield | Strength (MPa) Ultimate tensile | Ductility (%) Total elongation | Ductility (%) Reduction in area |
|---|---|---|---|---|---|
| FAL-B8 | OIL | 403.8 | 487.4 | 23.1 | 26.3 |
| | AIR | 389.9 | 491.5 | 24.8 | 27.2 |
| FAL-B12 | OIL | 579.5 | 661.3 | 6.5 | 6.5 |
| | AIR | 581.4 | 656.8 | 5.5 | 5.4 |
| FAL-B16 | OIL | 382.8 | 738.4 | 8.4 | 7.1 |
| | AIR | 377.7 | 608.7 | 5.5 | 5.4 |
| FAL-T8 | OIL | 470.7 | 559.3 | 21.0 | 33.7 |
| | AIR | 470.7 | 567.4 | 22.8 | 29.7 |
| FAL-T12 | OIL | 538.3 | 763.4 | 9.6 | 7.4 |
| | AIR | 532.8 | 772.0 | 9.2 | 7.4 |
| FAL-T16 | OIL | 336.1 | 664.5 | 11.9 | 9.4 |
| | AIR | 321.7 | 578.1 | 8.5 | 7.7 |
| FAL-TC8 | OIL | 467.6 | 577.6 | 28.5 | 32.8 |
| | AIR | 452.9 | 578.7 | 27.5 | 38.8 |
| FAL-TC12 | OIL | 566.5 | 771.2 | 8.5 | 7.0 |
| | AIR | 548.2 | 792.7 | 9.6 | 7.5 |
| FAL-TC16 | OIL | 323.7 | 580.8 | 8.6 | 14.3 |
| | AIR | 325.6 | 557.8 | 7.5 | 9.8 |
| FAL-TCZ8 | OIL | 475.7 | 580.9 | 25.0 | 32.2 |
| | AIR | 389.6 | 490.8 | 25.2 | 28.6 |
| FAL-TCZ12 | OIL | 621.9 | 802.5 | 14.0 | 20.9 |
| | AIR | 618.2 | 810.0 | 13.7 | 17.0 |
| FAL-TCZ16 | OIL | 343.5 | 702.8 | 12.1 | 8.9 |
| | AIR | 324.5 | 586.9 | 8.0 | 7.6 |

Figure 2:
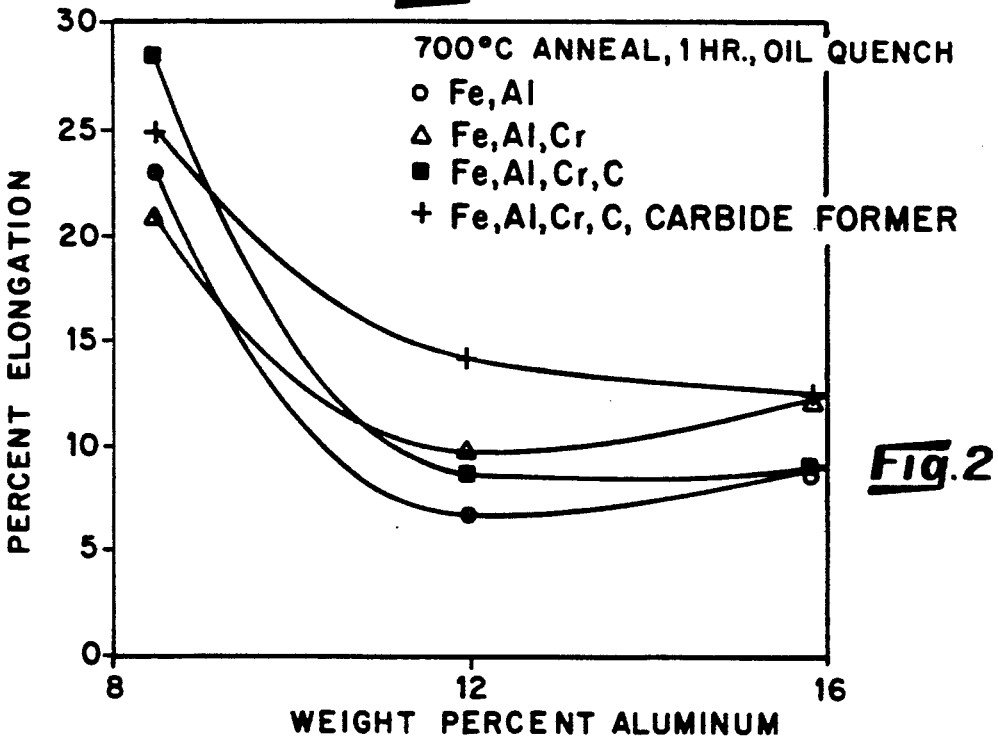
FIGS. 2, 3 and 4 are graphs respectively illustrating room-temperature ductility, yield strength and ultimate yield strength as a function of aluminum content for various wrought Fe-Al alloys after heat treating at 700° C. for one hour and oil quenching.
Figure 3:
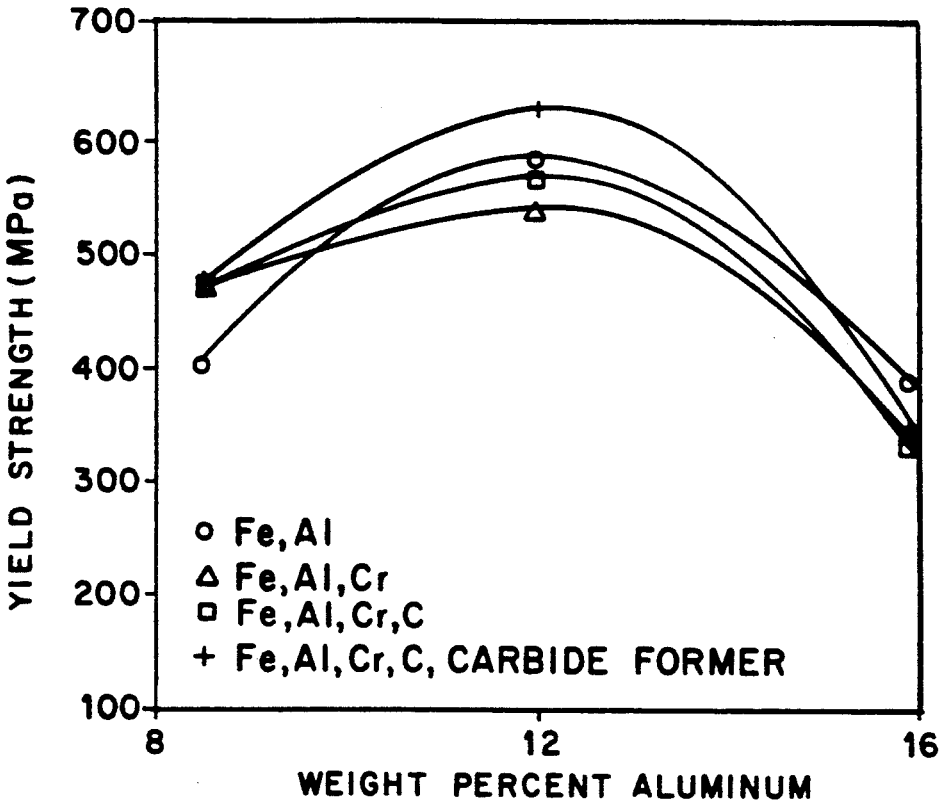
Figure 4:
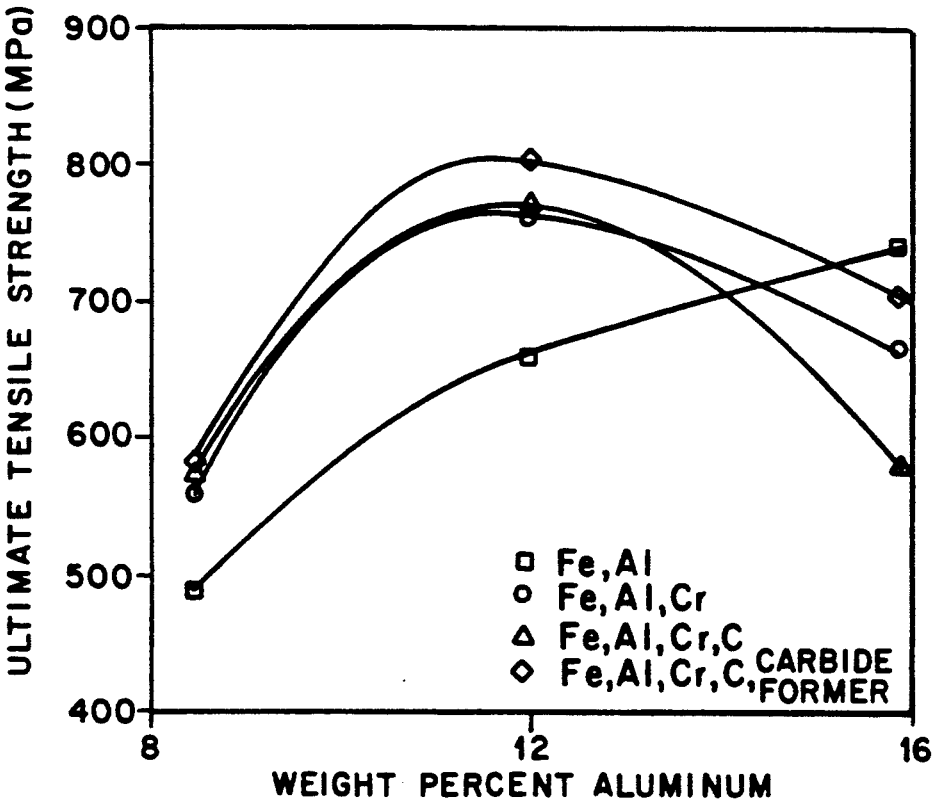

As shown in Table 2 the Fe-Al alloys of the present invention possess considerably more room-temperature ductility than Fe-Al alloys with 12 and 16% aluminum while maintaining yield strengths at 0.2% and ultimate tensile strengths favorably compared with the alloys having higher aluminum content. FIGS. 2, 3, and 4 further illustrate that the room temperature elongation, yield strength, and ultimate tensile strength of oil quenched alloys of Table 1 are a direct function of aluminum concentration. Note in FIGS. 2, 3, and 4 that the presence of various alloying constituents has a dramatic effect on the extent of room-temperature ductility, the yield strength, and the ultimate tensile strength of Fe-Al alloys listed in Table 1.

Table 3 illustrates the tensile properties of the FAL-T8 and the FAL-T12 tested in air and vacuum for determining the presence of hydrogen embrittlement. The tensile elongation values of the FAL-T12 alloy are lower in the air tested specimen than in the vacuum tested specimen which increased 4% in vacuum indicating the presence of hydrogen embrittlement in the air-tested specimens. In comparison the FAL-T8 alloy of the present invention has relatively uniform tensile elongation values for both the air-tested and the vacuum tested alloys, indicating that the alloys of the present invention are not sensitive to the reaction of aluminum and moisture in air causing hydrogen embrittlement.

TABLE 3

| Alloy | Cooling Medium | Test environment | Strength (MPa) 0.2% Yield | Strength (MPa) Ultimate tensile | Total elongation (%) |
|---|---|---|---|---|---|
| FAL-T8 | OIL[b] | Air | 515 | 654 | 25.2 |
| | OIL[b] | Air | 516 | 641 | 22.0 |
| | AIR[b] | Air | 519 | 652 | 23.4 |
| | AIR[b] | Air | 508 | 642 | 24.4 |
| | AIR[b] | Vacuum | 551 | 654 | 24.9 |
| | AIR[bc] | Air | 516 | 646 | 24.9 |
| | AIR[bc] | Air | 525 | 648 | 20.4 |
| FAL-T12 | OIL[b] | Air | 585 | 841 | 9.4 |
| | OIL[b] | Air | 620 | 867 | 10.0 |
| | AIR[b] | Air | 598 | 929 | 10.0 |
| | AIR[b] | Air | 596 | 915 | 10.0 |
| | AIR[b] | Vacuum | 637 | 938 | 14.0 |
| | AIR[bc] | Air | 719 | 936 | 5.0 |
| | AIR[bc] | Air | 721 | 912 | 3.4 |

[b]Annealed at 700° C. for 1 h prior to cooling.
[bc]In addition to treatment, specimens also were given a 6½-day treatment at 500° C. This treatment is used for maximizing the amount of any $DO_3$ phase present.

Figure 5:
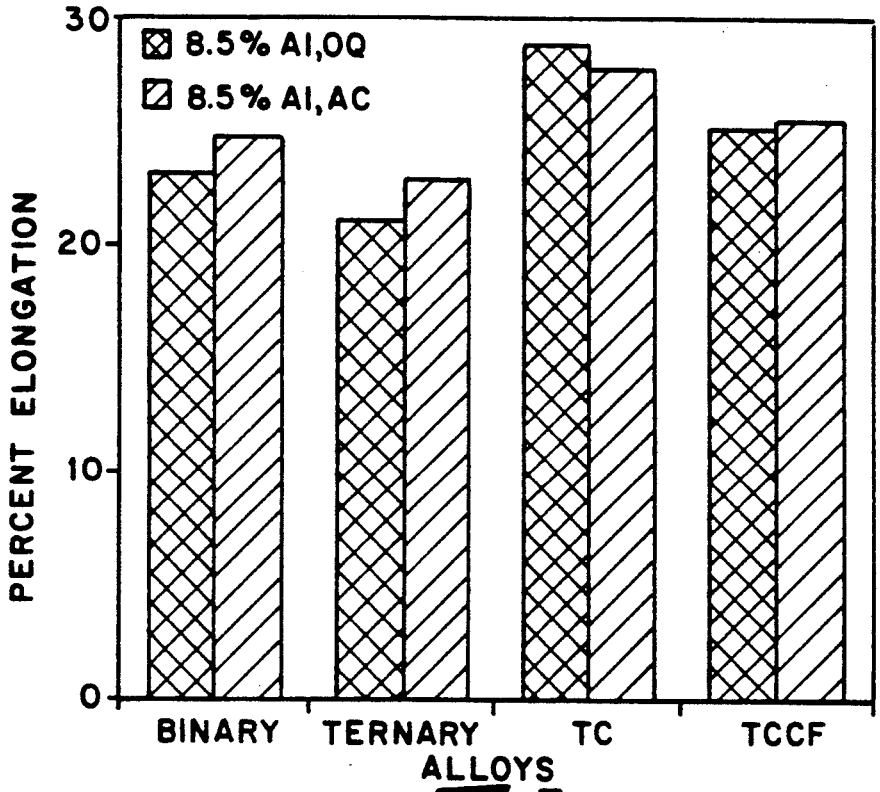
FIGS. 5, 6 and 7 are bar graphs respectively showing the effects of annealing at 700° C. and oil quenching or air cooling have upon room-temperature elongation of Fe-8.5% Al alloys, Fe-12% Al alloys, and Fe-16% Al alloys.
Figure 6:
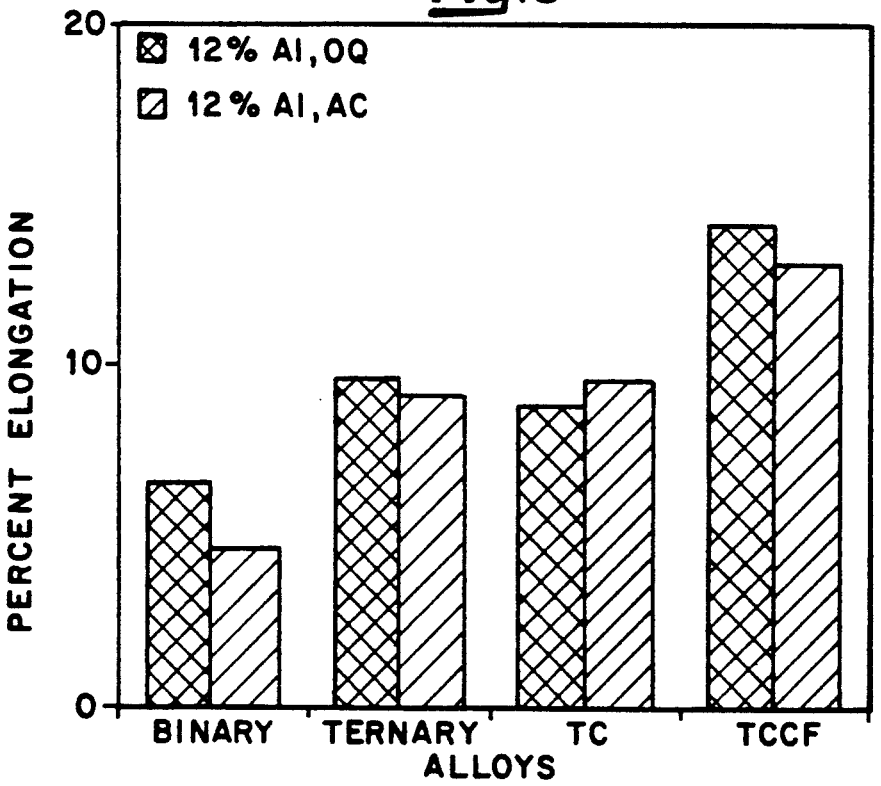
Figure 7:
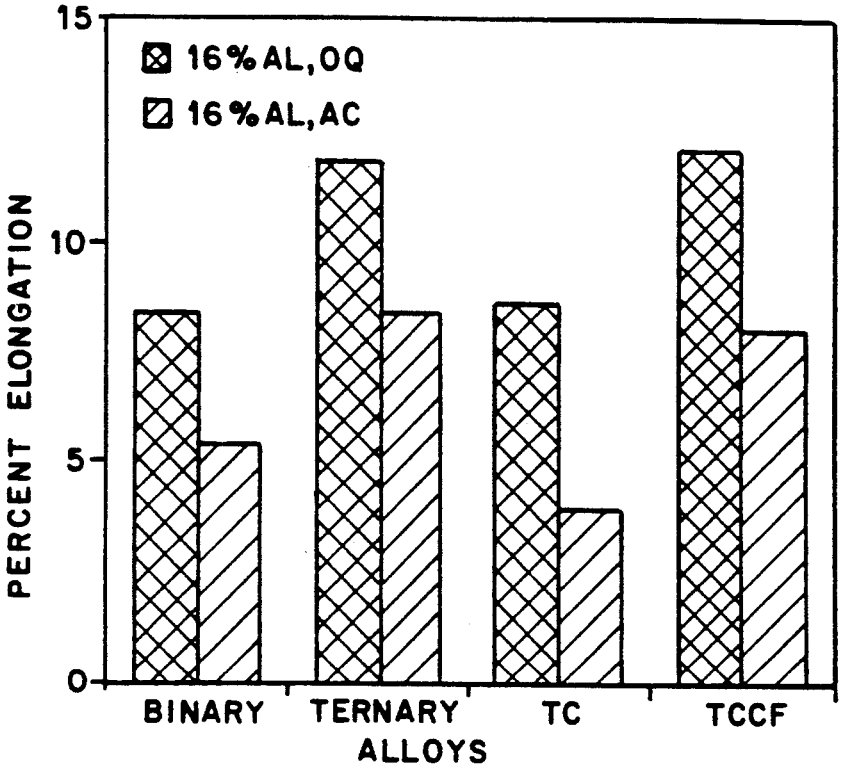

FIGS. 5, 6, and 7 respectively illustrate the effect alloying elements have upon the room-temperature ductility of Fe-8.5% Al alloys, Fe-12% Al alloys and Fe-16% Al alloys. All the alloys in these tests were quenched in mineral oil or air cooled after a one hour heat treatment at 700° C. The Fe-8.5% Al alloys showed essentially no difference in room-temperature ductility between air cooled and oil quenched alloys whereas the air cooled Fe-16% Al alloys had ductility values less than the oil quenched alloys, indicting the presence of hydrogen embrittlement.

Figure 8:
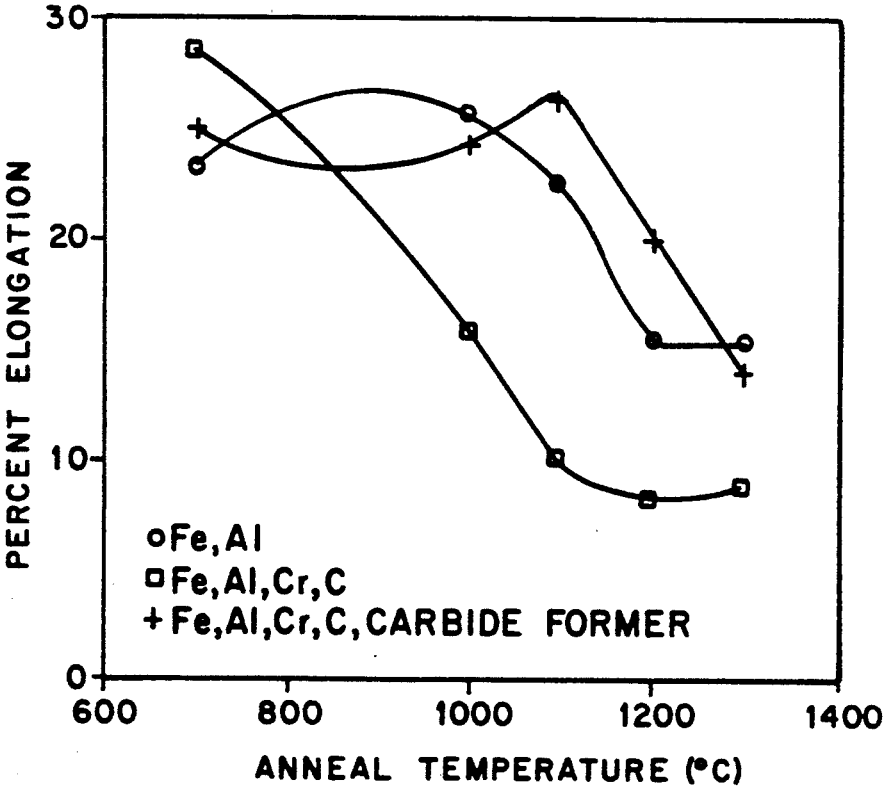
FIGS. 8 and 9 are graphs respectively illustrating the effect of annealing at selected temperatures in the range of about 700° to 1300° C. and oil quenching has upon the room-temperature ductility and grain size of Fe-Al alloys of the present invention.
Figure 9:
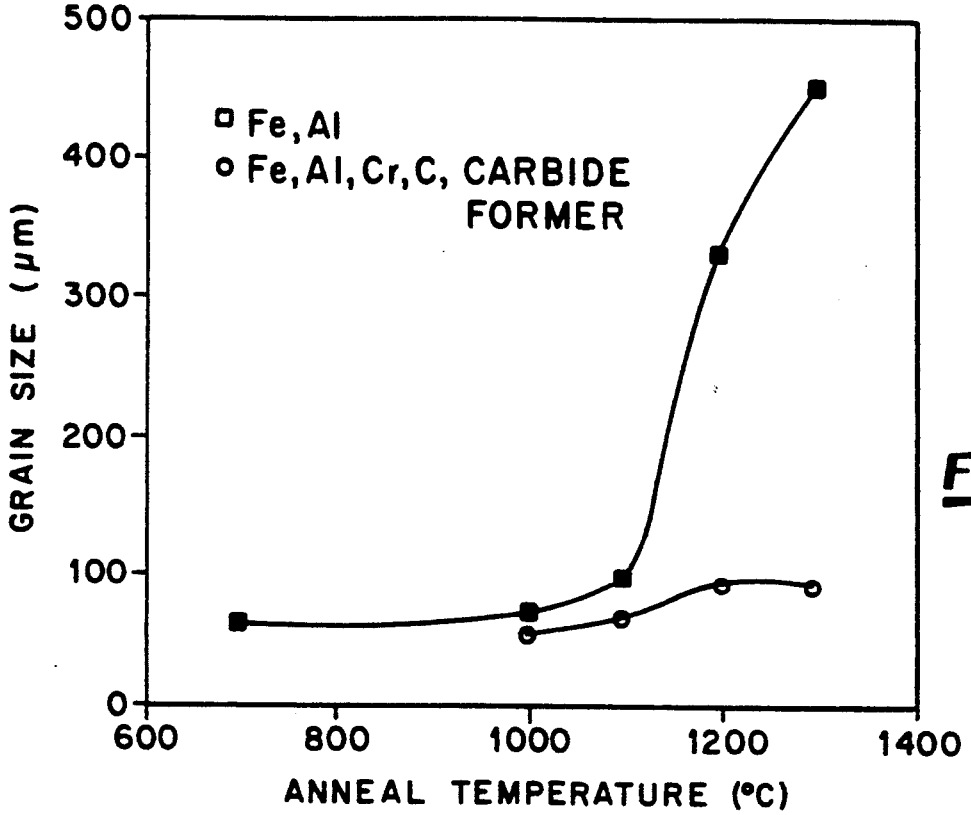
Figure 10:
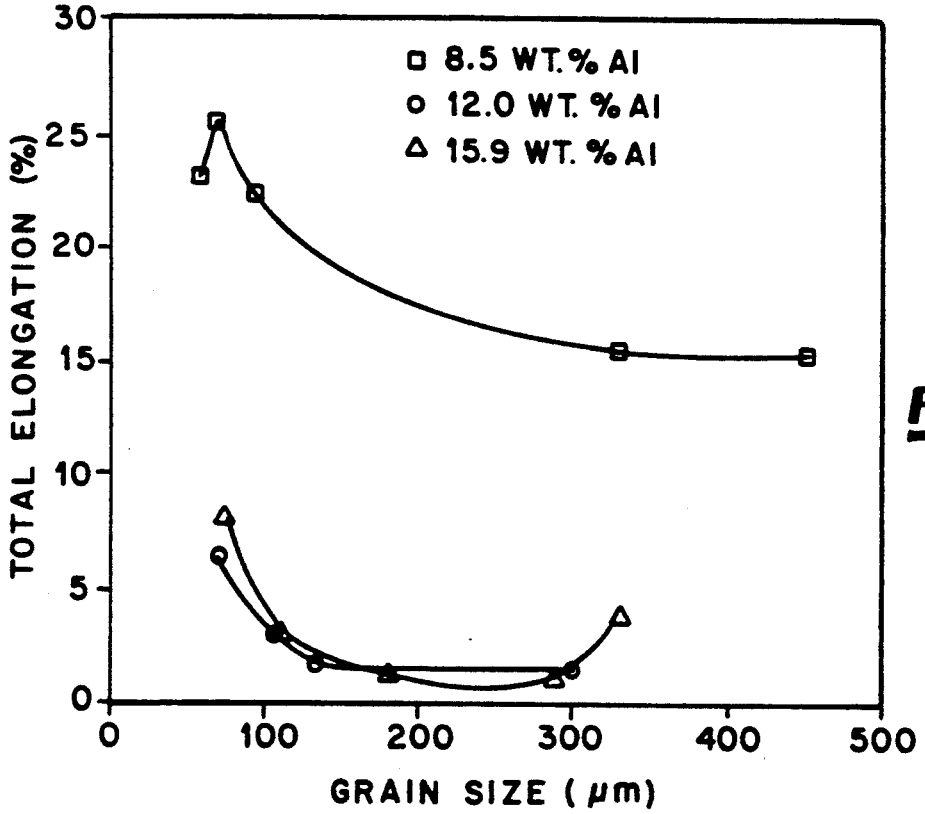
FIG. 10 is a graph illustrating the effects of grain size and aluminum content have on room temperature elongation of binary Fe-Al alloys.

FIGS. 8 and 9 illustrate the effect various annealing temperatures for 1 hour followed by oil quenching has on the room-temperature ductility and grain size of Fe-8.5% Al-based alloys. As shown in FIG. 8, the room-temperature ductility of greater than 20% can be selectively provided by annealing the alloys of the present invention at different selected temperatures in the range of 700° C. to about 1100° C. except for the ternary chromium-containing alloy and the alloy of the preferred composition which have maximum annealing temperatures of about 900° C. for providing these particular alloys with room-temperature ductilities of 20% or greater. FIG. 9 shows that little change in grain size occurs in the binary Fe-8.5% Al alloy at temperatures between 700° to 1100° C. and that the grain size of the 8.5% aluminum alloys containing chromium, carbon and zirconium exhibit a slight increase in grain size at temperatures between 1100° C. and 1300° C. FIG. 10 shows that grain growth has a dramatic affect on the room-temperature ductility of the Fe-Al alloys of different aluminum content. Thus, with the Fe-Al alloys of the present invention undergoing only slight grain growth at temperatures between 700° C. and 1100° C., the room-temperature ductility of these alloys can be effectively tailored by the choice of annealing temperatures. Note in FIG. 10 that a grain size between 50 and 75 μm provides the alloy with a high level of ductility. FIG. 9 shows that the annealed wrought alloys of the present invention have grain sizes predominantly between 50 and 75 μm when annealed at temperatures between 700° C. and 1100° C.

Figure 11:
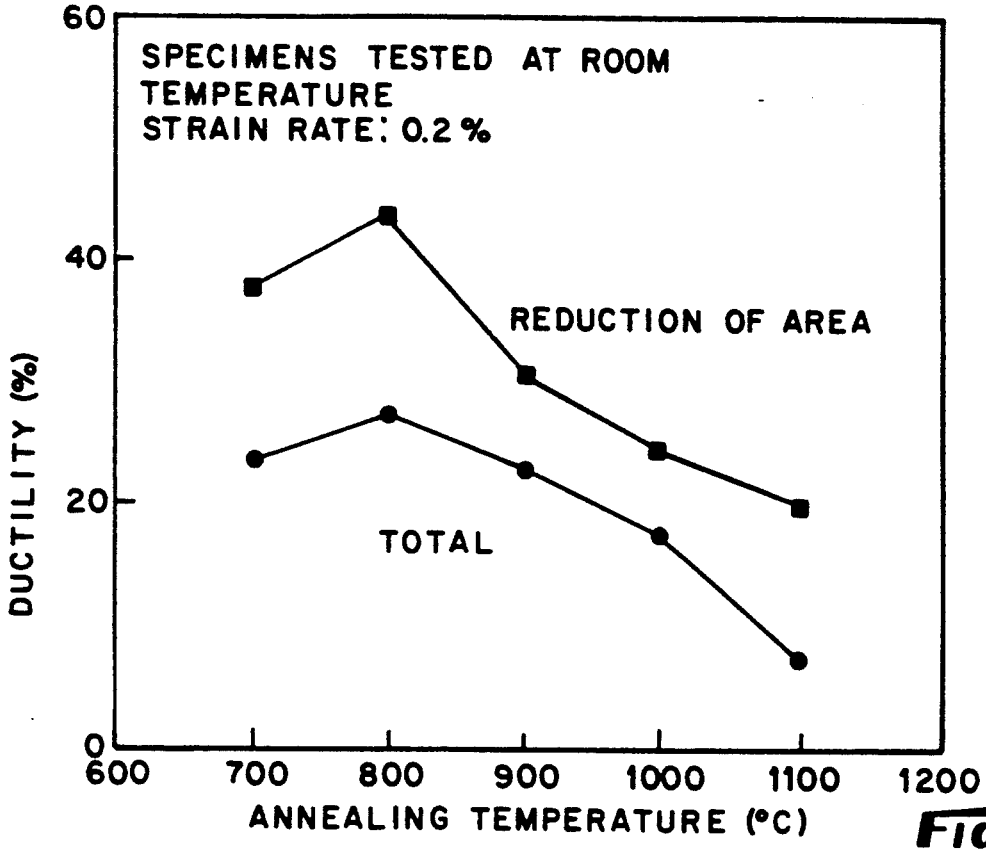
FIGS. 11 and 12 are graphs respectively showing the effect of different annealing temperatures has on room-temperature elongation and the yield and ultimate tensile strengths of the preferred Fe-8.46% Al-5.5% Cr-2.0% Mo-0.026%C-0.2% Zr alloy of the present invention.
Figure 12:
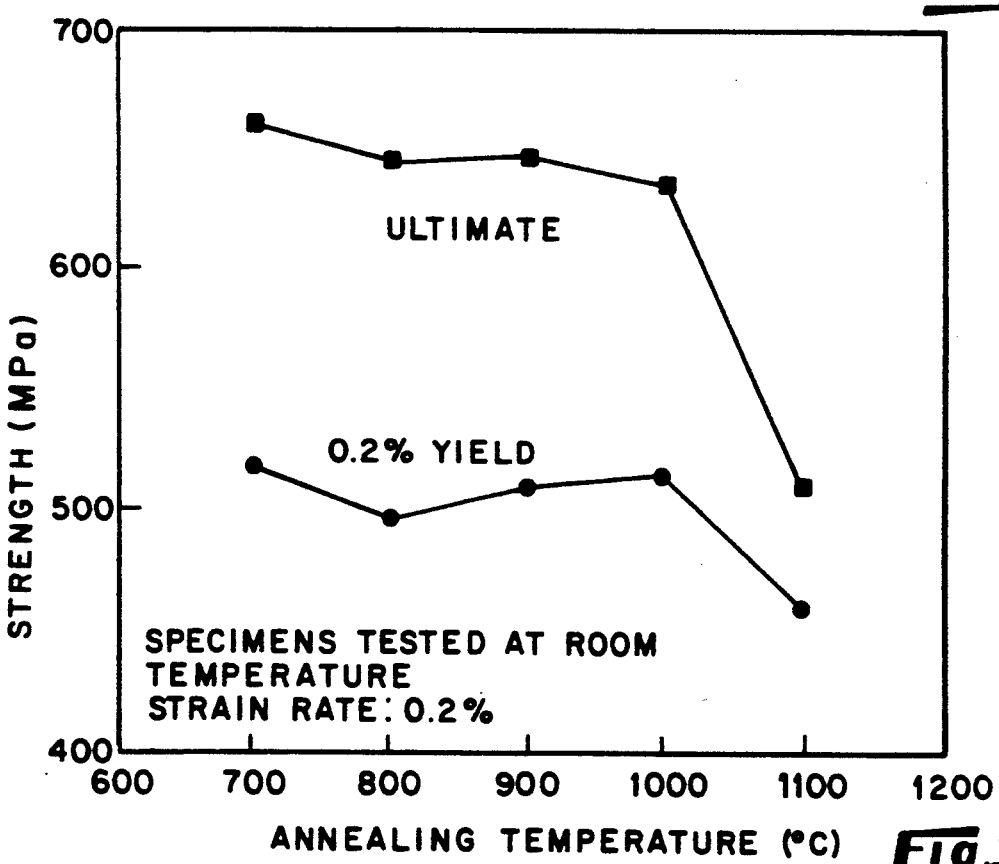

FIGS. 11 and 12 show the effect of annealing temperature on the room-temperature ductility, yield strength, and ultimate tensile strength of the Fe-8.5% Al-5% Cr-2% Mo-0.2% Zr-0.026% C alloy. As illustrated in these figures the increasing of the temperature for annealing purposes between about 700° C. to about 900° C. permits the tailoring of the room-temperature ductility for the preferred alloys of the present invention in such a manner that the room-temperature ductility and to some extent the strength of these alloys can be preselected by the choice of annealing temperature.

Table 4 further illustrates the effect of the annealing temperatures between 1000° C. and 1300° C. for the alloys of the compositions listed in Table 1 except for the FAP alloy. As shown in this table and as described above the annealing temperatures between about 700° C. to 1100° C. provide for the ductilities of greater than 20% for the Fe-8.5% Al alloys except in the case for the FAL-TC8 alloy where a 1000° C. annealing temperature reduces the ductility of this alloy to approximately 16%. When using this alloy composition a maximum annealing temperature of about 900° C. will provide a room-temperature ductility for the alloy at a level greater than 20%. Table 4 also illustrates that the high temperature anneals do not adversely effect the ultimate tensile strength and yield strength of the alloys so as to have little effect on their use in various applications. On the other hand, the exposure of the Fe-12% Al and the Fe-16% Al alloys to these high annealing temperatures causes a significant reduction in the tensile and yield strengths of the alloys. Table 4 also shows that the Fe-12% Al alloys and the Fe-16% Al alloys undergo a drop in ductility for all annealing temperatures greater than 1000° C. due to grain growth.

TABLE 4

| Alloy | Annealing temp (°C.) | Strength (MPa) 0.2% Yield | Strength (MPa) Ultimate tensile | Ductility (%) Total elongation | Ductility (%) Reduction in area |
|---|---|---|---|---|---|
| FAL-B8 | 1000 | 383.5 | 477.2 | 25.3 | 32.3 |
| | 1100 | 371.1 | 463.0 | 22.3 | 27.7 |
| | 1200 | 355.5 | 401.7 | 15.4 | 23.2 |
| | 1300 | 321.2 | 360.0 | 15.0 | 17.3 |
| FAL-B12 | 1000 | 567.5 | 630.8 | 3.2 | 3.7 |
| | 1100 | 548.9 | 590.8 | 1.8 | 3.8 |
| | 1200 | 496.4 | 533.0 | 1.3 | 5.5 |
| FAL-B16 | 1000 | 416.7 | 552.6 | 3.1 | 4.2 |
| | 1100 | 418.2 | 495.0 | 1.4 | 4.8 |
| | 1200 | 369.4 | 402.4 | 1.1 | — |
| FAL-TC8 | 1000 | 491.7 | 586.1 | 15.9 | 16.2 |
| | 1100 | 579.9 | 645.6 | 10.0 | 10.1 |
| | 1200 | 338.4 | 362.0 | 8.1 | — |
| FAL-TC12 | 1000 | 553.9 | 625.2 | 3.9 | 3.9 |
| | 1100 | 656.7 | 704.9 | 1.3 | 2.6 |
| | 1200 | 560.4 | 621.8 | 4.9 | 9.0 |
| FAL-TCZ8 | 1000 | 447.4 | 551.5 | 24.0 | 31:2 |
| | 1100 | 441.9 | 557.4 | 26.4 | 36.6 |
| | 1200 | 431.5 | 543.0 | 19.9 | 23.6 |
| | 1300 | 394.5 | 506.1 | 13.9 | 18.8 |
| FAL-TCZ12 | 1000 | 468.6 | 650.4 | 6.8 | 6.7 |
| | 1100 | 472.5 | 623.6 | 4.8 | 5.5 |
| | 1200 | 369.5 | 517.2 | 6.4 | 11.7 |
| | 1300 | 413.6 | 541.8 | 3.8 | 6.0 |
| FAL-TCZ16 | 1000 | 339.1 | 660.8 | 10.7 | 9.6 |

TABLE 4-continued

| Alloy | Annealing temp (°C.) | Strength (MPa) 0.2% Yield | Strength (MPa) Ultimate tensile | Ductility (%) Total elongation | Ductility (%) Reduction in area |
|---|---|---|---|---|---|
| | 1100 | 332.6 | 633.2 | 9.7 | 8.5 |
| | 1200 | 311.3 | 456.3 | 7.9 | 8.6 |

The preferred alloy composition of the present invention is based on the alloy composition containing 8% to 9% aluminum, 4.5% to 7.0% chromium, 1.8% to 2.2% molybdenum, 0.15% to 0.25% zirconium, 0.018% to 0.032% carbon, and the balance iron. More preferably, as illustrated in Table 1, the alloy composition of the present invention consists essentially of 8.46% aluminum, 5.5% chromium, 2.0% molybdenum, 0.20% zirconium, and 0.026% carbon, and the balance iron. Also, the addition of 0.1% yttrium to the preferred alloy composition is desirable for significantly increasing the oxidation of the alloys as will be described in greater detail below.

The alloys of the preferred compositions are believed to provide the best combination of the various properties of the iron-aluminide alloys of the present invention in that the preferred alloy compositions possess room temperature ductilities between 22% and 29% depending on the annealing temperature, the "as cast" alloy possesses a fracture strength considerably greater than the 12% aluminum alloys in that the 8.5% aluminum alloys broke after a load of 5000 pounds as opposed to a load of only 500 pounds for the 12% aluminum alloy. In fact, the fracture surface of the 8.5% aluminum alloys showed a ductal failure. When the "as cast" alloy of the preferred composition is heat treated at a temperature of 800° C. for 1 hour and air cooled, the alloy exhibits a room-temperature ductility of about 1.0% and an ultimate tensile strength of about 76 ksi. The preferred alloys also exhibit no or essentially no hydrogen sensitivity due to moisture in air, good aqueous corrosion resistance, high resistance to pitting, and high temperature oxidation resistance. The preferred alloy has been found to be easily cast into various product shapes.

In Table 5 the preferred alloy was exposed to different annealing temperatures to determine the effect these temperatures had on the tensile properties of this alloy. The preferred alloy, having the FAP composition listed in Table 1, and provided by air induction melting into a 15 pound heat and rolled to a 30 mil sheet was punched into specimens as cold rolled sheet and annealed for one hour at 800° C. followed by air cooling prior to testing. The letter L after the numerical designation of the specimens means that these specimens were tested in a longitudinal direction relative to the rolling direction whereas the letter T indicates that the specimens were tested in a transverse orientation.

TABLE 5

| Specimen | Heat Treat (°C.) | Strength (MPa) 0.2% Yield | Strength (MPa) Ultimate tensile | Ductility (%) Total elongation | Ductility (%) Reduction in area |
|---|---|---|---|---|---|
| 22L | 700 | 517 | 646 | 25.90 | 42.70 |
| 23L | 700 | 525 | 659 | 20.90 | 32.30 |
| 24L | 800 | 494 | 632 | 28.80 | 40.80 |
| 25L | 800 | 511 | 646 | 25.80 | 46.50 |
| 44T | 800 | 541 | 661 | 24.34 | 44.69 |
| 45T | 800 | 527 | 660 | 26.00 | 42.96 |
| 26L | 900 | 521 | 639 | 20.00 | 18.60 |
| 27L | 900 | 508 | 644 | 25.30 | 42.10 |
| 28L | 1000 | 518 | 626 | 16.00 | 27.30 |

TABLE 5-continued

| Specimen | Heat Treat (°C.) | Strength (MPa) 0.2% Yield | Strength (MPa) Ultimate tensile | Ductility (%) Total elongation | Ductility (%) Reduction in area |
|---|---|---|---|---|---|
| 29L | 1000 | 521 | 633 | 18.60 | 21.00 |
| 30L | 1100 | 472 | 523 | 10.20 | 25.30 |
| 31L | 1100 | 468 | 508 | 4.0 | 13.90 |

Table 5 illustrates that the room-temperature testing of the preferred alloy had little effect on the ductility of the specimens until the annealing temperature exceeded about 900° C. where a sharp drop occurred in the ductility but not in the strength of the specimens. Accordingly, the annealing temperature for the preferred alloy is preferably maintained between about 700° C. to 900° C. in order to maintain the desirable room-temperature ductility.

FIGS. 11 and 12 further illustrate the effect annealing temperature has upon the tensile properties of the alloy of the preferred composition set forth in Table 1. FIG. 11 is directed to the changes in room-temperature ductility as the annealing temperature is increased and shows that with annealing temperatures greater than about 900° C. the room-temperature ductility of the alloy drops below 20%. Hence, in order to maintain a level of room-temperature ductility greater than 20% annealing temperatures for the preferred alloy between about 700° C. to 900° C. are required. FIG. 12 indicates that the ultimate tensile strength and the strength at 0.2% yield of the preferred alloy remains fairly constant between an annealing temperature of 700° C. to about 1000° C. but drops off very sharply after annealing at 1000° C.

Figure 13:
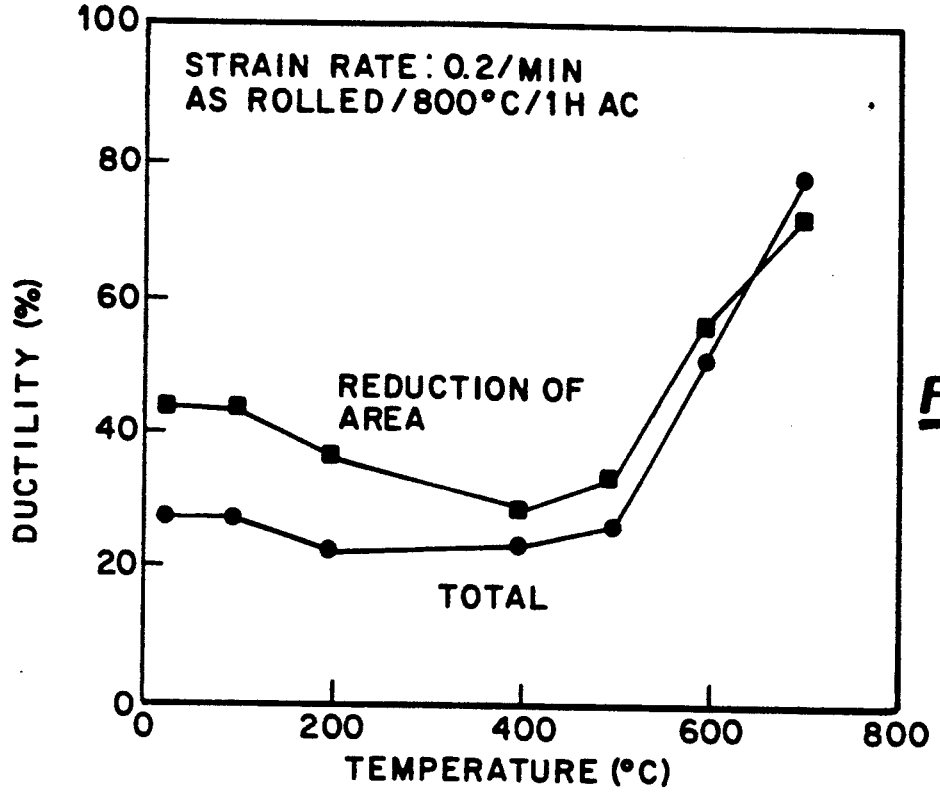
FIGS. 13 and 14 are graphs respectively illustrating the ductility and the yield and ultimate tensile strengths of the preferred alloy described in reference to FIG. 11 when the alloy is subjected to a wide range of temperatures and when the alloy was induction melted and in as "as rolled" condition before annealing.
Figure 14:
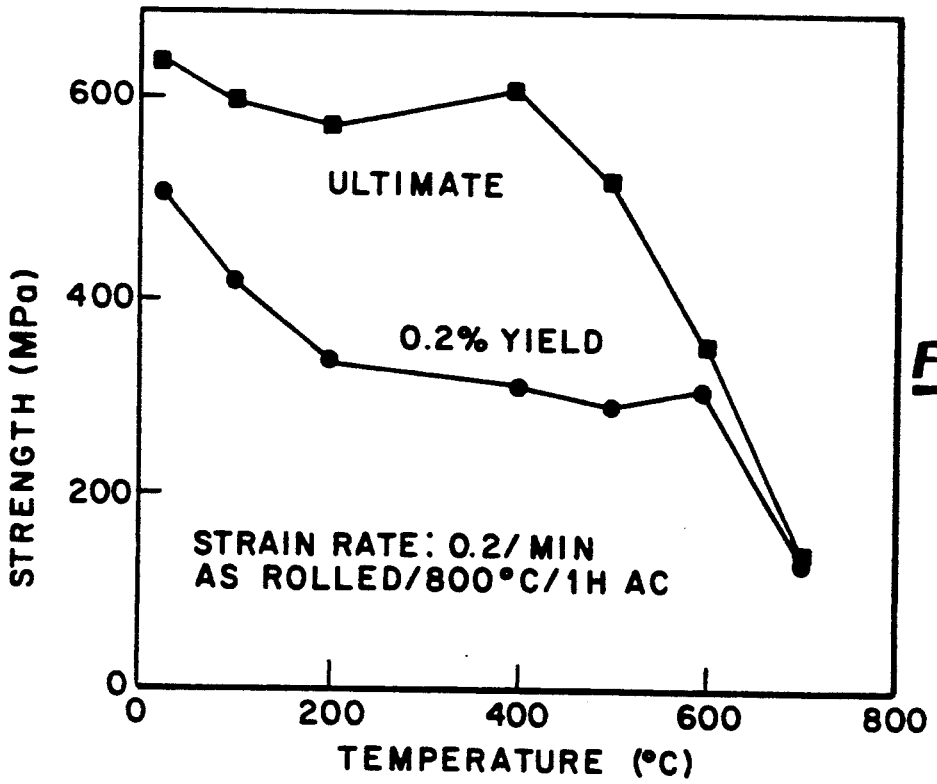

Table 6 and FIGS. 13 and 14 illustrate the testing of the alloy having the preferred composition set forth above at temperatures in the range of about 25° C. to 700° C. These alloys were initially formed by air induction melting into a 15 pound heat and rolled to a 30 mil sheet. These specimens were than punched as cold-rolled sheet and annealed for one hour at 800° C. followed by air cooling prior to testing. The temperatures for these alloys as shown in Table 6 range from 25° C. to 700° C. As illustrated in this table and FIGS. 13 and 14, the tensile strength of the preferred alloy dropped off considerably after 600° C. but not to the same extent as the previous $Fe_3Al$ alloy such as described in assignees aforementioned U.S. Pat. No. 5,084,109.

TABLE 6

| Specimen | Test temp (°C.) | Strength (MPa) 0.2% Yield | Strength (MPa) Ultimate tensile | Ductility (%) Total elongation | Ductility (%) Reduction in area |
|---|---|---|---|---|---|
| 24L | 25 | 494 | 632 | 28.8 | 40.80 |
| 25L | 25 | 511 | 646 | 25.8 | 46.50 |
| 44T | 25 | 541 | 611 | 24.34 | 44.69 |
| 45T | 25 | 527 | 660 | 26.00 | 42.96 |
| 32L | 100 | 418 | 594 | 27.66 | 43.94 |
| 33L | 100 | 408 | 599 | 26.26 | 43.18 |
| 34L | 200 | 340 | 574 | 21.52 | 33.98 |
| 35L | 200 | 321 | 568 | 22.54 | 38.73 |
| 36L | 400 | 299 | 605 | 22.28 | 31.88 |
| 37L | 400 | 311 | 611 | 23.14 | 25.13 |
| 38L | 500 | 271 | 494 | 26.14 | 38.10 |
| 39L | 500 | 300 | 538 | 25.26 | 27.42 |
| 40L | 600 | 314 | 354 | 46.70 | 54.00 |
| 41L | 600 | 290 | 340 | 55.30 | 59.15 |
| 42L | 700 | 129 | 130 | 79.60 | 70.77 |
| 43L | 700 | 118 | 130 | 75.70 | 73.87 |

In fact, as shown in FIG. 12 the ultimate strength for the preferred alloy is greater than 90 ksi for annealing temperatures between 700° to about 1000° C.

Figure 15:
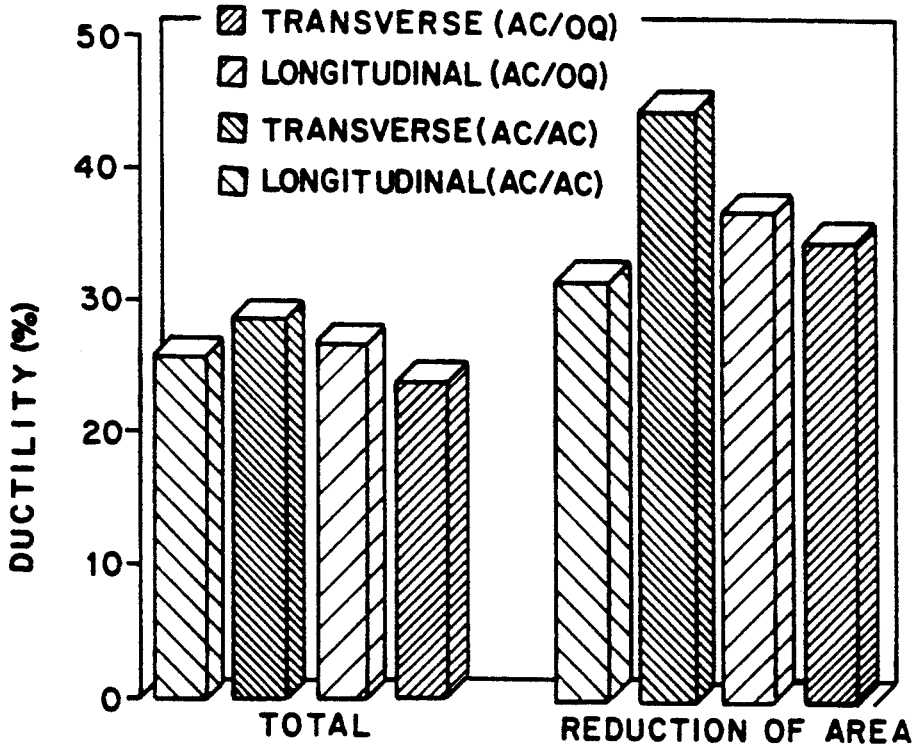
FIGS. 15 and 16 are bar graphs respectively illustrating the ductility and the yield and ultimate tensile strengths of preferred Fe-Al alloy described in reference to FIG. 11 as wrought and annealed at 700° C. and tested in both transverse and longitudinal directions and with comparisons between oil quenched and air cooled specimens.
Figure 16:
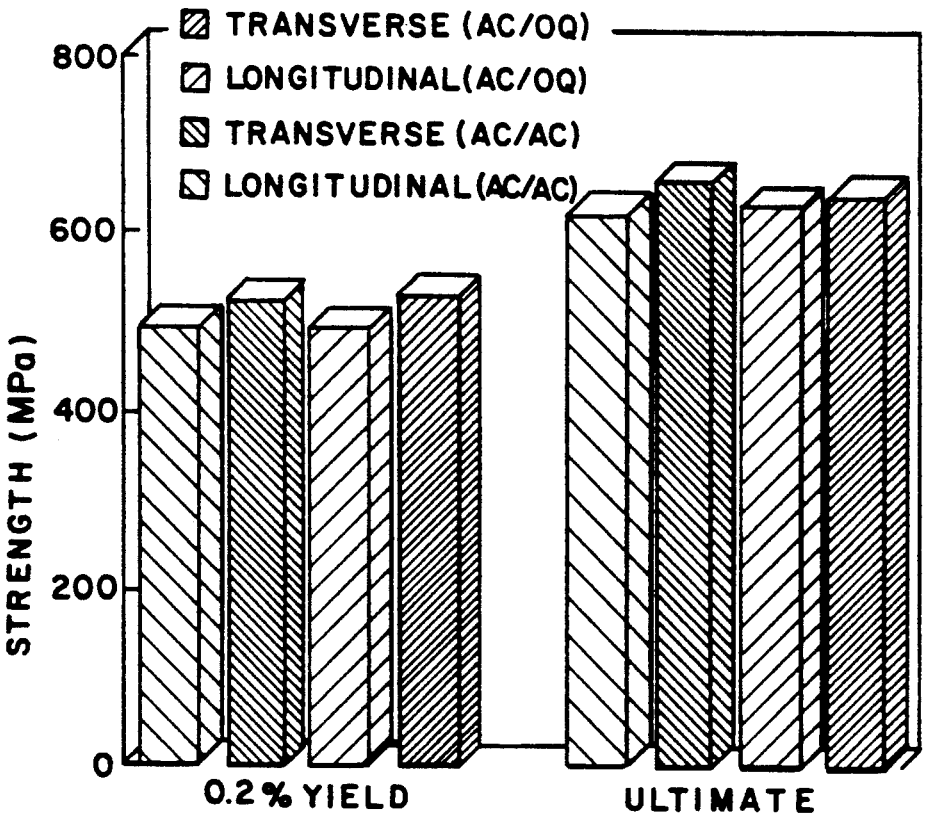

FIGS. 15 and 16 show that the alloy of the preferred composition (FAP) of Table 1 demonstrates desirable strength and ductilities in both longitudinal and transverse directions. As shown the ductility, the yield strength, and the ultimate tensile strength remain fairly uniform when tested in both transverse and longitudinal directions whether air cooled or oil quenched. This essentially uniform ductility and strength for the alloys of the present invention was somewhat unexpected due to the disordered phase present in the alloys since it was thought that such alloys would have less ductility and strength in the transverse direction than in the longitudinal direction. It is also expected that alloys of the present invention with compositions other than the preferred composition will also exhibit substantially uniform tensile properties in the longitudinal and transverse directions.

As briefly mentioned above, the addition of yttrium in a concentration of about 0.1% has a desirable effect upon the oxidation resistance of the alloys of the present invention. It was found that the addition of 0.1% yttrium as shown in Table 7 when compared to a 0% yttrium addition and a 0.5% yttrium addition had little effect on the tensile properties of the alloy especially the ductility whereas the 0.5% yttrium addition reduced the room-temperature ductility of the alloy. Accordingly, it is believed that the additions of about 0.1% yttrium would be beneficial in use of all the alloy systems of the present invention since such additions do not deleteriously effect the tensile properties of the alloys.

TABLE 7

| Alloy | Y (wt. %) | Strength (MPa) 0.2% Yield | Strength (MPa) Ultimate tensile | Ductility (%) Total elongation | Ductility (%) Reduction in area |
|---|---|---|---|---|---|
| FAP | 0 | 494 | 632 | 28.80 | 40.80 |
| | | 511 | 646 | 22.80 | 46.50 |
| FAP-Y1 | 0.1 | 512 | 652 | 25.00 | 38.89 |
| | | 511 | 648 | 25.48 | 37.48 |
| FAP-Y2 | 0.5 | 522 | 683 | 23.90 | 30.21 |
| | | 513 | 673 | 17.16 | 23.41 |

It will be seen that the Fe-Al alloys of the present invention possess a highly desirable combination of properties including ductilities of over 20% at room temperature for wrought, fine grained alloys, little or no susceptibility to hydrogen embrittlement, high resistance to aging at 500° C., and exhibit ductility in as cast forms. The room-temperature ductility of the binary alloy composition can be increased by adding certain alloying elements. For example, the preferred FAP alloy listed in Table 1 has a tailorable room-temperature ductility between about 22 and 29%. While the strength of the preferred alloy composition is not much different from that of the other alloys of the present invention based upon the Fe-8.5% Al compositions, the preferred alloys possess a combination of properties that would be suitable for the manufacturing of components possessing good room-temperature ductility independent of environmental and orientation effects.

What is claimed is:

1. A wrought and annealed iron-aluminum alloy consisting essentially of 8 to 9.5% aluminum, an effective amount of chromium sufficient to promote resistance to aqueous corrosion of the alloy, and an alloying constituent selected from the group of elements consisting of an effective amount of molybdenum sufficient to promote solution hardening of the alloy and resistance of the alloy to pitting when exposed to solutions containing chloride, up to about 0.05% carbon with up to about 0.5% of a carbide former which combines with the carbon to form carbides for controlling grain growth at elevated temperatures, and mixtures thereof, and the balance iron, wherein said alloy has a single disordered α phase crystal structure, is substantially non-susceptible to hydrogen embrittlement, and has a room-temperature ductility of greater than 20%.

2. A wrought and annealed iron-aluminum alloy as claimed in claim 1, wherein the carbide former is zirconium.

3. A wrought and annealed iron-aluminum alloy as claimed in claim 1, wherein the effective amount of chromium is in a range of more than incidental impurities up to about 7.0%.

4. A wrought and annealed iron-aluminum alloy as claimed in claim 1, wherein the alloy contains both the carbon and the carbide former with the carbon being present in an effective amount in the range of more than incidental impurities up to about 0.05% and with the carbide former being in an effective amount sufficient amount in the range of more than incidental impurities up to about 0.5%, and wherein the effective amounts of the carbon and the carbide former are each sufficient to together provide for the formation of sufficient carbides to control grain growth in the alloy during exposure thereof to increasing temperatures.

5. A wrought and annealed iron-aluminum alloy as claimed in claim 4, wherein the carbide former is zirconium.

6. A wrought and annealed iron-aluminum alloy as claimed in claim 4, wherein the alloy further includes yttrium in a concentration of about 0.1%.

7. A wrought and annealed iron-aluminum alloy as claimed in claim 1, wherein the alloying constituents are provided by molybdenum, carbon and the carbide former, and wherein the effective amount of molybdenum is in a range of more than incidental impurities up to about 4.0%.

8. A wrought and annealed iron-aluminum alloy as claimed in claim 1, wherein the effective amount of chromium is in the range of more than incidental impurities up to about 7.0%.

9. A wrought and annealed iron-aluminum alloy as claimed in claim 1, wherein the alloy consists essentially of 8 to 9.5% aluminum, about 2 to 7% chromium, about 1 to 4% molybdenum, about 0.02 to 0.05% carbon, about 0.1 to 0.5% of the carbide former, and the balance iron, wherein the alloy has a room-temperature yield strength at 0.2% yield of at least about 70 ksi in longitudinal and transverse directions and a room-temperature ultimate tensile strength of at least about 90 ksi in longitudinal and transverse directions.

10. A wrought and annealed iron-aluminum alloy as claimed in claim 9, wherein the aluminum is in a concentration of essentially 8.5%.

11. A wrought and annealed iron-aluminum alloy as claimed in claim 9, wherein the carbide former is zirconium in a concentration of about 0.2 to 0.5%.

12. A wrought and annealed iron-aluminum alloy consisting essentially of 8 to 9% aluminum, about 4.5 to 5.5% chromium, about 1.8 to 2.2% molybdenum, about 0.020 to 0.032% carbon, about 0.15 to 0.25% zirconium, and the balance iron, wherein said alloy has a single disordered α phase with a body-centered-cubic crystal structure, is substantially non-susceptible to hydrogen embrittlement, and has a room-temperature ductility of greater than 20%.

13. A wrought and annealed iron-aluminum alloy as claimed in claim 12, wherein the alloy has a room-temperature ductility of at least about 22% in both longitudinal and transverse directions, has a room-temperature yield strength at 0.2% yield of at least about 70 ksi in longitudinal and transverse directions, and has a room-temperature ultimate tensile strength of at least about 90 ksi in longitudinal and transverse directions.

14. A wrought and annealed iron-aluminum alloy as claimed in claim 1, wherein the room temperature elongation of greater than 20% is in the range of 20 to about 29%.

15. A method for preparing an iron-aluminum alloy having a single disordered α phase crystal structure and characterized by a room-temperature ductility of greater than 20% and by being essentially non-susceptible to hydrogen embrittlement, comprising the steps of:

(a) forming a blend of alloy constituents comprising 8 to 9.5% aluminum, one or more alloying elements selected from chromium in a concentration up to about 7%, molybdenum in a concentration up to about 4%, carbon in a concentration up to about 0.05%, and a carbide former in a concentration up to about 0.5% and adequate to combine with the carbon for forming grain-growth inhibiting carbides in the alloy;

(b) forming a melt of the alloy constituents;

(c) working the resulting alloy; and (d) annealing the resulting wrought alloy at a selected temperature greater than about 700° C. followed by air cooling or oil quenching for providing the alloy with said room-temperature ductility of greater than 20%.

16. A method for preparing an iron-aluminum alloy as claimed in claim 15, wherein the step of annealing the wrought alloy at a selected temperature greater than about 700° C. is provided by heating the wrought alloy to a temperature in the range of about 700° C. to about 1100° C., and wherein the heating of the wrought alloy to the selected temperature in said range provides the wrought alloy with a selected room-temperature ductility in the range of 20 to about 29%.

17. A method for preparing an iron-aluminum alloy as claimed in claim 15, wherein the carbide former is about 0.2 to 0.5% zirconium.

18. A method for preparing an iron-aluminum alloy as claimed in claim 15, wherein the alloy constituents include about 0.1% yttrium.

19. A method for preparing an iron-aluminum alloy as claimed in claim 15, wherein the step of working the resulting alloy is provided by mechanically working the alloy though a series of thickness reductions.

20. A method for preparing an iron-aluminum alloy as claimed in claim 15, wherein the step of working the resulting alloy includes working the alloy at room temperature through a series of thickness reductions with heat treating of the alloy at a temperature of about 800° C. after each of said series of thickness reductions.

21. A method for preparing an iron-aluminum alloy as claimed in claim 15, wherein the alloy constituents comprise 8 to 9% aluminum, about 4.5 to 5.5% chromium, about 1.8 to 2.2% molybdenum, about 0.020 to 0.032% carbon, about 0.15 to 0.25% zirconium, and the balance iron.

22. A method for preparing an iron-aluminum alloy as claimed in claim 21, wherein the room-temperature ductility of greater than 20% is a room-temperature ductility in the range of 20 to about 29%, and wherein the selected annealing temperature greater than about 700° C. is a temperature in the range of about 700° C. to about 900° C.

23. A method for preparing an iron-aluminum alloy as claimed in claim 22, wherein the alloy constituents further comprise about 0.1% yttrium.

24. An iron-aluminum alloy comprising 8 to 9% aluminum, about 4.5 to 5.5% chromium, about 1.8 to 2.2% molybdenum, about 0.020 to 0.032% carbon, about 0.15 to 0.25% zirconium, about 0.1% yttrium, and the balance iron, wherein said alloy has a single disordered $\alpha$ phase with a body-centered-cubic crystal structure, is substantially non-susceptible to hydrogen embrittlement, and has a room-temperature ductility of greater than 20% when wrought and annealed at a temperature greater than about 700° C. and air cooled or oil quenched.

* * * * *

UNITED STATES PATENT AND TRADEMARK OFFICE

CERTIFICATE OF CORRECTION

PATENT NO. : 5,238,645

DATED : August 24, 1993

INVENTOR(S) : Vinod K. Sikka and Claudette G. McKamey

It is certified that error appears in the above-indentified patent and that said Letters Patent is hereby corrected as shown below:

On the title page, and Column 1, line 3, following the word "ROOM-TEMPERATURE" insert the word —DUCTILITY—.

Signed and Sealed this

Thirteenth Day of September, 1994

*Attest:*

*Attesting Officer*

BRUCE LEHMAN

*Commissioner of Patents and Trademarks*